United States Patent [19]

Neenan

[11] 4,456,174

[45] Jun. 26, 1984

[54] ADJUSTABLE PULSE JET

[76] Inventor: John S. Neenan, 4100 Maple Tree Dr., Anaheim, Calif. 92807

[21] Appl. No.: 361,109

[22] Filed: Mar. 23, 1982

Related U.S. Application Data

[63] Continuation-in-part of Ser. No. 093,754, Nov. 13, 1979, Pat. No. 4,320,541.

[51] Int. Cl.[3] ..... A61H 9/00; A47K 3/00; B05B 1/08

[52] U.S. Cl. ..... 239/8; 4/492; 4/542; 4/568; 137/888; 239/383; 239/428.5

[58] Field of Search ..... 239/8, 222.17, 222.21, 239/380–389, 428.5; 261/DIG. 75; 137/888, 892; 128/66, 370; 4/492, 507, 541–543, 567, 568

[56] References Cited

U.S. PATENT DOCUMENTS

| | | | |
|---|---|---|---|
| 475,452 | 5/1882 | Keen | 239/222.21 |
| 1,446,887 | 2/1923 | Donovan | 239/383 |
| 1,826,208 | 10/1931 | Gibson | 239/222.21 X |
| 2,260,301 | 10/1941 | Cushman | 239/222.21 X |
| 2,878,066 | 3/1959 | Erwin | 239/383 |
| 3,424,250 | 1/1969 | Thomae | 239/428.5 |
| 3,471,091 | 10/1969 | Baker | 239/416 |
| 3,473,736 | 10/1969 | Heitzman | 239/416 X |
| 3,568,716 | 3/1971 | Heitzman | 137/624.14 |
| 3,601,316 | 8/1971 | Murray | 239/222.21 |
| 3,628,529 | 12/1971 | Steimle | 128/66 |
| 3,664,585 | 5/1972 | Curtis | 239/381 X |
| 3,713,587 | 1/1973 | Carson | 239/383 |
| 3,777,746 | 12/1973 | Kwok | 128/66 |
| 3,890,655 | 6/1975 | Mathis | 4/542 |
| 3,890,656 | 6/1975 | Mathis | 4/542 |
| 3,905,358 | 9/1975 | Jacuzzi | 128/66 |
| 3,946,449 | 3/1976 | Mathis | 128/66 X |
| 4,101,075 | 7/1978 | Heitzman | 239/101 |
| 4,204,495 | 5/1980 | Wyner | 239/383 X |

*Primary Examiner*—Andres Kashnikow

[57] ABSTRACT

A venturi-type mixer that produces an aerated water jet for spas, therapy pools, swimming pools and the like is provided with a pulsating action by means of a rotating flow disturbing blade mounted at the discharge end of the jet nozzle to repetitively intercept the increased velocity stream discharged by the nozzle. The flow disturbing blade has its velocity controlled and adjusted by means of a water-driven turbine rotor journalled upstream of the nozzle and geared to the flow disturbing blade. The amount of projection of the turbine rotor blades into the water stream is varied by changing the relative alignment of non-circular input passage to the jet nozzle with respect to a congruent non-circular input passage from the main water supply.

20 Claims, 6 Drawing Figures

ADJUSTABLE PULSE JET

FIELD OF THE INVENTION

The present application is a continuation-in-part of my U.S. application for Method and Apparatus for Providing a Pulsating Air/Water Jet, Ser. No. 93,754, filed Nov. 13, 1979, now U.S. Pat. No. 4,320,541 the disclosure of which is hereby incorporated by this reference as though fully set forth herein.

BACKGROUND OF THE INVENTION

The present invention relates to venturi type mixing of gas and liquids and more particularly concerns such types of mixing that produce a pulsating discharge of the mixture.

In spas, therapy pools, swimming pools and similar apparatus, jets of water are projected into the body of water contained in the spa, pool or tub to provide a type of hydro-massage, enhanced relaxation and other therapeutic benefits. To increase the action, force and benefit of such jets, the water, before projection, is mixed with air by means of air/water mixers that commonly employ a venturi type action. By this venturi action an increased velocity jet projected into a mixing chamber provides an area of reduced pressure that pulls air into the chamber through a passage that communicates with ambient atmosphere. The air pulled into the chamber mixes with the water and the mixture is discharged through a nozzle into (below the surface of) the body of water contained in the spa or pool tub. Venturi type mixers for spas, therapy pools and the like are typified by those in the U.S. Pat. Nos. 3,471,091 to Baker; Steimle, U.S. Pat. No. 3,628,529; Jacuzzi, U.S. Pat. No. 3,905,358; Mathis, U.S. Pat. No. 3,890,544; and Mathis, U.S. Pat. No. 3,890,656.

The enhanced massaging and therapeutic actions of pulsating nonaerated water jets are well known and typical devices for providing such water pulsations (without air entrainment) are shown in the U.S. Pat. No. 2,878,066 to Erwin; Donovan, U.S. Pat. No. 1,446,887; Heitzman, U.S. Pat. No. 3,473,736; and Heitzman, U.S. Pat. No. 4,101,075. Pulsed water jets of the prior art have either repetitively diverted the water flow from the desired outlet or repetitively stopped water flow into the water outlet. Prior efforts to provide a pulsed air/water mixer have merely followed principles used in pulsation of nonareated water streams and employed devices to either stop or divert the water flow before it enters the mixing chamber.

Devices that totally obstruct the water flow can cause abrupt pressure increases and noise, imposing severe strains upon the system. Devices attempting to control air flow have generally required external controlling mechanisms and thus become less efficient, more complex, and more costly.

My prior application, Ser. No. 93,754, discloses methods and apparatus for intermittently disturbing venturi action that takes place within the mixing chamber of a venturi type jet so that the resulting discharge of mixed air and water is suitably pulsed. A rotary flow disturbing member, journalled at the nozzle output so as to be driven by the high velocity jet stream is among the more simple of the arrangements disclosed in my prior application. This rotary member intermittently disturbs the stream so as to intermittently disturb the venturi action. Many considerations require that such a flow disturbing member be quite small. Accordingly, its velocity of rotation is high and fixed by physical and flow parameters. A preferred pulsing action occurs at a rate significantly slower than the high rate of rotation of a small rotary disturbing member that is driven by the high velocity jet stream. Adjustable pulsation is often desired. Further, certain provisions in the nature of added elements or configurations of the disturbing member must be provided to ensure start of rotation upon initiation of liquid flow. Such arrangements are not readily adjustable without changing configuration or dimensions of parts.

Accordingly, it is an object of the present invention to provide a venturi type mixer that avoids or eliminates above-mentioned problems and limitations.

SUMMARY OF THE INVENTION

In carrying out principles of the present invention in accordance with a preferred embodiment thereof, a venturi type action is employed to mix gas with a liquid stream of increased velocity and to thereby reduce pressure in a mixing chamber. At a point within the mixing chamber downstream of the jet nozzle, the flow of liquid into the chamber is intermittently disturbed by a journalled flow disturbing member and means are provided within the mixer for controlling rotation of the flow disturbing member. Preferably, such control means also ensures start-up of the flow disturbing rotation. It may take the form of a rotor mounted upstream of the nozzle and positioned to intercept a portion of the flowing liquid, the rotor and flow disturbing member being interconnected. According to a feature of the invention, the speed of rotation of the rotor may be varied by varying the amount of the projection of the rotor into the flow passage upstream of the nozzle.

DETAILED DESCRIPTION

Figure 1:
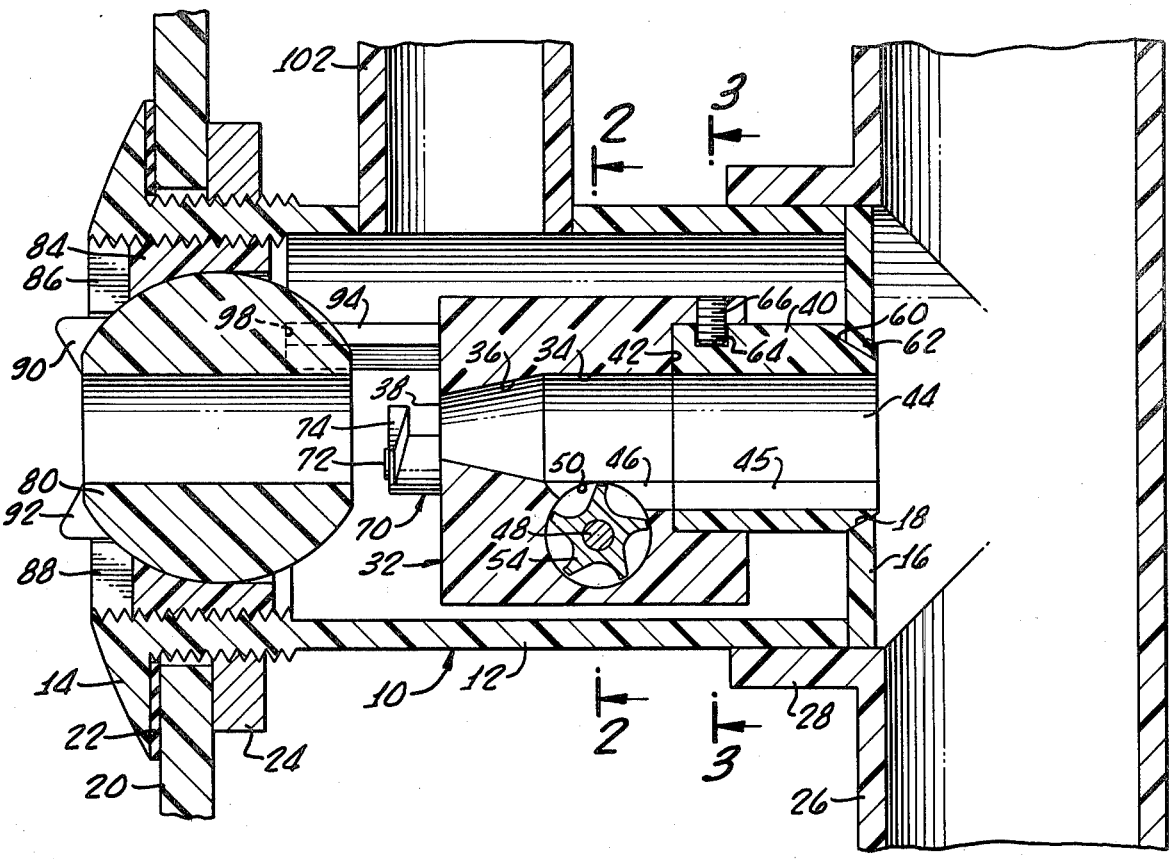
FIG. 1 is a sectional view of a pulsating venturi type mixer embodying principles of the present invention.
Figure 2:
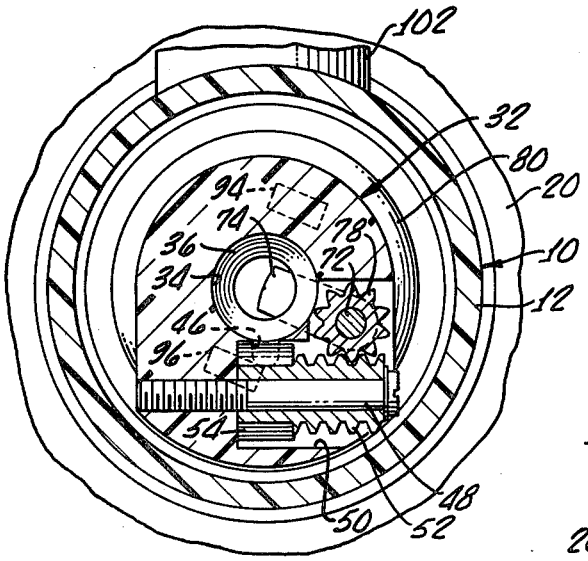
FIGS. 2 and 3 are cross-sections of the illustration of FIG. 1 taken on lines 2—2 and 3—3, respectively.
Figure 3:
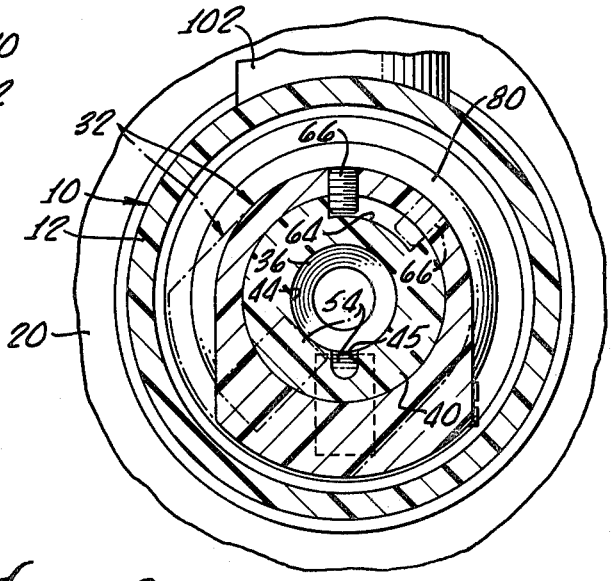

As shown in FIGS. 1, 2 and 3, a venturi type air/water mixer has a jet housing or mixer body 10 formed of a tube 12 having an inner flange 14 at a forward end. The forward end is both internally and externally threaded. A backplate 16 having a tapered aperture 18 is fixed to the rearward end of the tube. The jet housing 10 projects through and is secured to a wall 20 of a therapy pool, swimming pool, spa, or tub, with a gasket 22 interposed between the wall and the housing flange 14 and a nut 24 is threaded on the external threads of the housing and turned tight against the outside of the tub wall 20.

Water from a high power pump (not shown) is driven through a water conduit 26 having a plurality of stub fittings 28, of which one is illustrated in FIG. 1. It will be understood that the conventional therapy pool, swimming pool, and the like, has a number of venturi type pulsating jets, each identical to that illustrated in FIGS. 1, 2 and 3, mounted in the wall below the surface of the water, and spaced at intervals around the wall. Thus, the water under pressure from the pump flows through the conduit 26 and then into each of the mixers connected to its outlet stub fittings 28.

A pulsator housing or jet body 32 is formed with a nozzle entrance passage in the form of a right circular cylindrical bore section 34 which terminates at its downstream end at the beginning of a tapered nozzle passage or section 36 having a nozzle output 38 from which is projected a stream of high velocity liquid. The upstream end of nozzle entrance passage or bore 34 is enlarged to receive a coupling conduit 40 having a downstream end that seats against a rearwardly facing shoulder 42 of the pulsator housing and having a flow passage 44 that is coaxial with and of equal diameter to the nozzle entrance passage 34.

Nozzle entrance passage 34 has its main circular section radially extended at one point of its periphery by an auxiliary or turbine drive section 46 which extends forwardly from the upstream end of the nozzle entrance passage 34, to terminate at the upstream end of the nozzle passage section 36.

The coupling conduit 40 has its flow passage formed with a non-circular cross-section essentially congruent with the non-circular cross-section of the nozzle entrance passage (together with its turbine drive section). Accordingly, the coupling passage 44 includes a radially outwardly projecting turbine drive section 45 of relatively limited extent around the periphery of the main coupling passage section. Turbine drive section 45 may extend for the full length of conduit 40, or it may be formed at its downstream end.

A journal pin 48 is fixed in the pulsator housing and extends transversely of the axis of the nozzle and entrance passages, being displaced outwardly (downwardly with the housing oriented as shown in FIG. 1) of the outer portions of the entrance passage. Conveniently, the journal pin is formed by a headed bolt threaded into the pulsator housing. The pulsator housing has a cutout portion forming a cavity 50 through which the shank of the bolt 48 extends. Journalled on the bolt shank is a worm gear 52 fixedly carrying a rotor or multi-bladed turbine 54, both within cavity 50. The turbine freely rotates with its worm gear upon the journal pin 48 and has its blade positioned to extend into the radially outwardly projecting turbine drive section 46 of the nozzle entrance passage 34. However, the turbine blades fall just short of the outermost periphery of the main circular cross-section of the nozzle entrance passage so that flow through this passage is not intercepted by the main stream of the water flowing through the nozzle. Water flowing through the main section of the feed conduit or coupling passage 44 flows directly through the coaxial and equal diameter nozzle entrance section to the nozzle itself. Water flowing from the water pipe 26 into the auxiliary or turbine drive section of the coupling conduit, flows directly into the corresponding drive section 46 of the nozzle entrance section.

Water flowing through the turbine drive section 45 of the coupling passage flows into the turbine drive section 46 of the nozzle entrance passage where it impinges upon blades of the turbine 54 that project into and substantially entirely across the drive section. Accordingly, the turbine 54 is rotated by the water impinging upon its blades.

Figure 4:
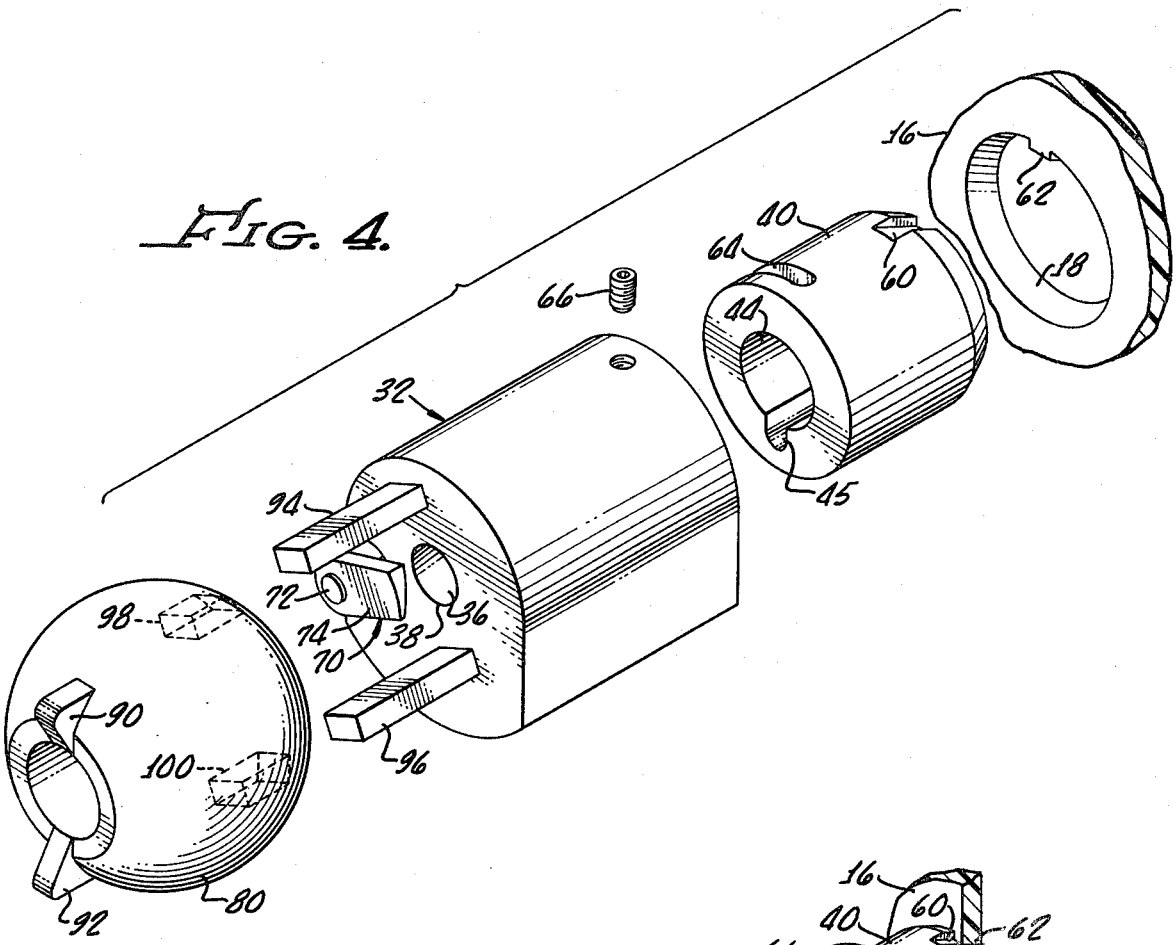
FIG. 4 is an exploded perspective view of portions of the pulsator mechanism.
Figure 6:
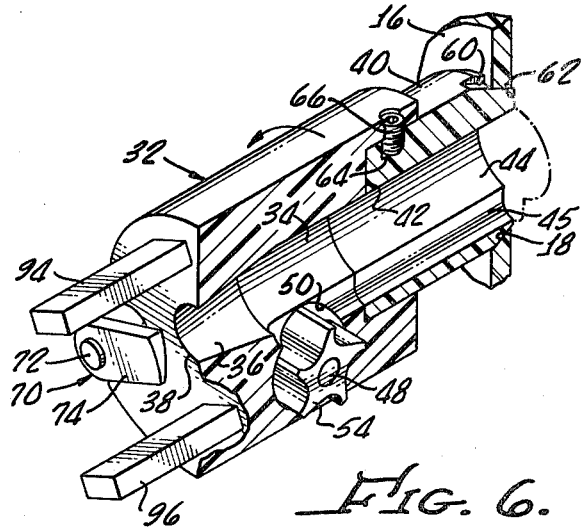
Figure 5:
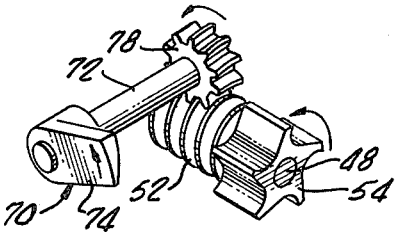
FIG. 5 is a perspective of the worm and gear interconnection between rotor and flow disturbing member; and, FIG. 6 is a perspective view of the pulsator housing and coupling inlet conduit illustrating the positions of the rotor and flow disturbing member.

Coupling conduit 40 has a tapered upstream end that seats upon the inclined tapered surface 18 of end plate 16 of the mixer housing 12 and is keyed thereto against rotation by means of a keyway 60 (see FIG. 4) in the coupling conduit that receives a radially inwardly projecting key 62 formed in the periphery of the aperture in endplate 16. A radially outwardly opening peripheral slot 64 extends approximately 45° around the outer surface of coupling conduit 40 and receives a set screw 66 threaded in the pulsator housing body and projecting into the slot to thereby allow a limited amount of rotation of the pulsator housing with respect to the coupling conduit 40 about the nozzle axis. Such relative rotation varies the degree of alignment of the nozzle entrance passage and the coupling passage for purposes to be described below.

A flow disturbing member in the form of a rotary hub 70 is fixed to a pin 72 rotatably mounted in a downstream end of the pulsator housing and extending parallel to the nozzle axis. Hub 70 fixedly carries a radially outwardly projecting disturbing vane 74 having a transversely inclined surface 76 positioned close to and extending partly across the nozzle orifice 38, when the flow disturbing member is in its position of maximum flow disturbance. Fixed to the upstream end of the journalled pin 72 is a gear 78 positioned in the cavity 50 and meshing with the worm gear 52 that is fixed to the turbine rotor 54. Accordingly, pivot pin 72 is journalled in the pulsator housing to provide for synchronous rotation of the disturbing vane 74 together with gear 78. The gear rotates in unison with worm 52 and turbine 54 so that rotation of the disturbing vane is controlled by rotation of the turbine rotor.

A discharge fitting 80 which may conveniently take the form of a substantially conventional eyeball fitting as shown in FIG. 1, is adjustably mounted in the discharge end of jet housing 10 by means of a collar 84 having an inner surface that bears upon the spherical outer surface of the discharge fitting 80. Collar 84 has external threads that engage the internal threads at the forward end of the jet housing. A plurality of inwardly directed holding and turning fingers 86, 88 are fixed to the collar 84 to assist in turning the collar into and out of its threaded engagement with the jet housing. A pair of ears 90, 92 are fixed to the discharge fitting 80 and extend forwardly into the body of water within the therapy pool, spa, or tub to enable rotational adjustment of the discharge fitting 80 when the collar 84 has been loosened.

A pair of non-circular cross-section connecting bars 94, 96 are fixed to the forward end of the pulsator housing and extend downstream for reception in corresponding non-circular recesses 98, 100 formed in the upstream end of the discharge fitting.

An air inlet fitting 102 is fixed to an air inlet port in the side of the jet housing 10 and adapted to be connected to a conduit that provides a flow of air to the interior of the mixing chamber formed within the jet housing at the downstream end of the nozzle.

In assembly of the apparatus, the jet housing 10, is inserted through the tub wall, from the interior of the tub, with a gasket 22 in place and the lock nut 24 is positioned and tightened. Water pipe 26 is then connected to the outer end of the jet housing. The pulsator housing 32, having the interconnected turbine rotor and flow disturbing member 70 mounted therein, is connected with the coupling conduit 40 and set screw 66 holds the two together. This sub-assembly is inserted through the forward or downstream end of the jet housing so that the upstream end of the coupling conduit seats upon and is keyed to the aperture in jet housing endplate 16. Discharge fitting 80 then is inserted through the forward end of the jet housing to cause its recesses 98, 100 to receive the downstream ends of rods 94, 96, whereupon collar 84 is screwed into place to firmly hold all of the parts in assembled condition. Alternatively, fitting 80 may be fixedly connected to jet body 32 and inserted into the housing 10 together with the jet body.

Assuming that the non-circular passages in the nozzle entrance section and the coupling conduit are aligned with one another with their respective turbine drive sections in mutual registration, water flowing under pressure through water supply pipe 26 flows through the coupling section and thence through the tapered nozzle to emerge from the nozzle orifice as an increased velocity water stream. Water flowing through the aligned or drive sections of the coupling passage and nozzle entrance passage strikes the turbine blades, causing the latter to rotate and thereby causing the flow disturbing member 70 to rotate in synchronism with the turbine rotor. As the flow disturbing member 70 rotates, it moves from a position of maximum flow disturbance as illustrated in FIG. 2, through various positions of considerably lesser disturbance and through various positions in which the blade 74 is entirely clear of the projected jet stream. In fact, with the arrangement illustrated, the disturbing blade is completely clear of the jet stream for considerably more than 180° of each revolution. Although the blade may extend entirely across the projected stream, it need extend only a short way into the stream and in the presently preferred embodiment will extend approximately to the stream center, as best seen in FIG. 2.

When the disturbing vane is clear of the exiting high velocity stream projected from the nozzle, the venturi effect produces a decreased pressure within the mixing chamber at the nozzle exit which accordingly pulls air into the mixing chamber via the air conduit 102. This air inlet port, as previously mentioned, is preferably positioned as close as reasonably possible to the nozzle orifice. The closer the air input is to the nozzle orifice, the greater the disturbing effect upon the venturi action. As the vane rotates and interrupts the high velocity jet stream, the venturi action is disturbed, pressure within the mixing chamber rises, and the pulling of air into the chamber by the venturi action is greatly diminished.

The jet stream from the nozzle is directed axially of and entirely through the passage in discharge fitting 80 to enter the body of water within the therapy pool, spa or tub below the surface thereof. When the venturi action mixes this high velocity stream with air drawn into the mixing chamber, the air/water mixture that is discharged from the fitting 80 has a significantly greater force than does the same high velocity water stream having little or no air mixed therewith. Therefore, intermittently mixing air with the exiting jet stream projected by the nozzle, causes the discharged stream to pulsate, intermittently changing its intensity and force.

Thus, it will be seen that as the disturbing member 70 rotates, it intermittently disturbs or interrupts the jet stream to thereby intermittently interrupt pulling of air into the chamber and intermittently interrupt the mixing of the air and water. This action causes the discharged air/water mixture to pulsate.

Because the blade 74 of the disturbing member has a surface inclined to the axis of the high velocity water stream from the nozzle, and also partly because of the small size and light weight of this member, the high velocity water stream tends to rotate this member at an undesirably high velocity; at a velocity so high that the pulsations may be felt not as separate pulses, but merely as a very high frequency disturbance in the water jet discharged from the mixer. However, the illustrated arrangement actually slows down the rotational velocity of the flow disturbing member and, moreover, provides adjustable control of such rotational velocity. Because of the worm gear arrangement, the flow disturbing member 70 cannot drive the rotor. It is only the rotor 54 that can drive the flow disturbing member. Moreover, unless the rotor rotates, the flow disturbing member cannot. Accordingly, the rate of rotation of the flow disturbing member can be adjusted simply by adjusting the rotational speed of the turbine rotor.

Rotational speed of the turbine rotor is adjusted by relatively rotating the pulsator housing and coupling conduit 40. When collar 84 is loosened, the eyeball discharge fitting 80 may be rotated by means of ears 90, 92, to thereupon rotate the pulsator housing 32 relative to the coupling conduit 40 which is keyed against rotation relative to the backplate 16 of the jet housing. Relative rotation of the coupling collar and pulsator housing effects misalignment of the nozzle entrance passage and coupling passage. In particular, as can be seen in FIG. 3, the turbine and the drive section of the nozzle entrance passage can be rotated in a clockwise direction (as viewed in FIG. 3) to an extent limited by the interengaged slot and set screw 64, 66. In the extreme position of clockwise (as viewed in FIG. 3) rotation of the pulsator housing, drive section 46 of the nozzle entrance passage is laterally displaced from its position of alignment with the drive section 45 of the coupling passage, so as to effectively block flow of water into the nozzle passage turbine drive section 46 directly from the coupling passage drive section. In such a position of relative rotational adjustment the main circular section of the nozzle housing passage and coupling passage are still coaxial and still fully aligned so that the main flow of water from the water pipe through the coupling passage, through the nozzle entrance passage, and through the tapered nozzle remains largely unchanged and the water velocity is not significantly diminished. However, in such position of extreme adjustment, with turbine drive section 46 blocked, there is little or no water flow impinging upon the turbine blade and accordingly, the turbine is at rest or rotates at exceedingly small or negligible velocity. Because the turbine rotates at low velocity, the flow disturbing member or vane 74 will likewise rotate at low velocity. At intermediate positions of rotational adjustment, between the two extremes illustrated in FIG. 3, different amounts of water will impinge upon the turbine blades and accordingly the latter will be driven at different speeds according to the amount of rotational adjustment. Therefore, the rotational velocity of the flow disturbing member can be readily controlled merely by rotation of the discharge fitting 80 which is readily accessible to the user within the pool or tub. A highly important result of the control of the disturbing vane rotational velocity is the ability to greatly increase the dwell time of the disturbing vane within the high velocity jet stream during the course of the traverse of the vane across the stream. Such increase in dwell time further intensifies the resulting pulsating action of the discharged air/water mixture.

Because the drive sections of the nozzle entrance passage and coupling passages are of relatively small area compared to the main sections, there is an almost negligible loss of velocity due to the presence of the turbine. Further, because these drive sections are not separate small tubes or conduit, they cannot become clogged or plugged with dirt or debris. For this reason, it is important that the turbine be driven by a water flow that is part of the main stream, but at the same time minimizing the disturbing effect of the turbine on the main stream itself. This is achieved by the described use of turbine drive sections at the periphery of the main flow passages and locating the turbine blades outside of the main flow passage.

In addition to actually decreasing velocity of rotation of the disturbing vane 74 to a significant extent, the turbine provides a starting force for the flow disturbing rotation upon start-up of the water flow from the pipe 26. Should the apparatus be stopped with the vane 74 in a position entirely displaced from the nozzle, the flow of water will rotate the turbine and thereby rotate the flow disturbing nozzle to a point where it will receive further drive force by impingement of the exiting jet from the nozzle upon its inclined surface 76. The latter surface is inclined primarily to ensure that when the pulsator housing is adjustably rotated to provide a very small amount of force tending to rotate the turbine, there will still be a rotational force to ensure the rotation of the vane. If vane 74 is not inclined, it is possible that at a very low water force upon the turbines, the blade 74 will become fixed within the exiting jet stream and cease its rotation. The inclination of the vane surface avoids such a situation. It is noted that the turbine is positioned entirely upstream of the nozzle 36 to thereby minimize adverse affects of the turbine upon flow velocity.

The illustrated arrangement of radially outwardly projecting turbine drive sections of nozzle entrance passage and coupling passage is presently preferred to provide an adjustable drive on the turbine rotor. However, in an alternate arrangement, one of these passages may be made eccentric with respect to the other so that in one position of relative rotational adjustment, a maximum amount of water will flow through an eccentric portion of the coupling passage to impinge upon the turbine blades and, in another position of adjustment of the eccentric passage, a minimum amount of water would flow directly to the turbine. The arrangement illustrated in the drawings is preferred because it provides the least impediment to flow velocity and least decrease in flow velocity.

The arrangement illustrated in the drawings employs forwardly projecting rods 94, 96 received in apertures of the discharge fitting 80 so that the latter may be made quite similar to and interchangeable with a standard eyeball fitting. Thus, the pulsator housing and coupling conduit may be replaced with a standard jet nozzle if pulsation is not desired.

The foregoing detailed description is to clearly understood as given by way of illustration and example only, the spirit and scope of this invention being limited solely by the appended claims.

I claim:

1. In a venturi type mixer wherein an increased velocity stream of liquid in a liquid conduit is projected through a jet nozzle into a mixing chamber and pulls gas from a gas conduit into the mixing chamber by venturi action for mixture with the liquid and discharge from the chamber, the improvement comprising a flow disturbing member mounted for rotation in said mixing chamber downstream of said jet nozzle for intermittently disturbing the flow of liquid in said chamber so as to intermittently disturb the venturi action and the pulling of gas into the chamber, whereby the discharge of liquid and gas from the chamber pulsates, a rotor mounted upstream of said nozzle and positioned to intercept a portion of the stream of liquid from said liquid conduit, and means for interconnecting said rotor and flow disturbing member.

2. The apparatus of claim 1 including means for adjusting the rotational velocity of said rotor.

3. For use with a swimming pool, therapy pool, spa or the like having a pool wall confining a body of water, a pulsating air/water venturi type mixer for projecting an air/water mixture through the pool wall into the water below the surface thereof, said mixer comprising a mixer body defining a mixing chamber having air and water input ports and a mixture outlet, a jet nozzle in said mixing chamber positioned to project an increased velocity stream of water from said water input port along a path in said chamber toward said mixture outlet, said increased velocity stream causing a venturi action that pulls air from a gas conduit connected to said air input port into said chamber for mixing with water and discharge from the chamber, a flow disturbing member for intermittently disturbing the flow of water in said mixing chamber so as to intermittently disturb the venturi action and the pulling of air into said chamber, said flow disturbing member having at least a portion thereof mounted for motion in said mixing chamber downstream of said jet nozzle so as to repetitively intercept at least part of said stream and repetitively disturb said venturi action and the pulling of air into said chamber, whereby the air/water mixture discharged by the mixer pulsates, and means mounted in said body upstream of said jet nozzle for controlling motion of said flow disturbing member.

4. The mixer of claim 3 wherein said means for controlling motion comprises a turbine rotor mounted to said mixer body upstream of said nozzle, and gear means interconnecting said rotor and flow disturbing member.

5. A venturi type mixer comprising a mixer housing having air and water inlet ports adapted to be connected to air and water conduits, and having a discharge port, a nozzle body in said housing having a jet nozzle for projecting an increased velocity stream of water to said discharge port, and having a nozzle entrance passage, means for coupling said nozzle entrance passage with said water inlet port, a rotor journalled in said mixer housing and having blades projecting into an outer portion of said passage, a flow disturbing member journalled in said mixer housing downstream of said jet nozzle and positioned to intermittently intercept said increased velocity stream, and means for interconnecting said rotor and flow disturbing member.

6. The mixer of claim 5 including means for varying speed of rotation of said rotor.

7. The mixer of claim 6 wherein said means for varying comprises means for changing the amount of projection of said rotor blades into said outer portion of said passage.

8. The mixer of claim 5 wherein said nozzle entrance passage includes a main section and wherein said outer portion of said passage comprises a rotor drive section projecting outwardly from said main section, said means for coupling said nozzle passage and water inlet port having a coupling flow passage having main and rotor drive sections substantially aligned with corresponding sections of said nozzle entrance passage, and means for shifting said passages out of alignment with each other.

9. The mixer of claim 5 wherein said nozzle entrance passage is non-circular, said means for coupling said nozzle passage and water inlet including a non-circular coupling flow passage and means for relatively shifting said passages transversely of one another.

10. The mixer of claim 9 wherein said nozzle body and said means for coupling the nozzle entrance passage with said water inlet port are relatively rotatable.

11. Pulsating water discharge apparatus for a swimming pool, therapy pool, spa or the like comprising a housing defining a chamber having an input for receiving water under pressure and an output for discharging water beneath the surface of a swimming pool, therapy pool, spa or the like, said chamber having an air input for receiving air, a nozzle feed conduit in said housing and having a flow passage coupled with said water input, a jet body connected to said nozzle feed conduit and having a jet nozzle for projecting an increased velocity stream of water to said housing chamber output, said jet body having a nozzle entrance passage between said jet nozzle and said nozzle feed conduit, a flow disturbing member journalled upon said jet body and having a blade positioned to intermittently intercept at least a portion of a stream of water projected from said nozzle as the flow disturbing member rotates, a water driven rotor journalled in said jet body upstream of said nozzle and having driving blades projecting into an outer section of said flow passage, and means for connecting said rotor and flow disturbing member to rotate together.

12. The apparatus of claim 11 wherein said jet body is mounted for rotation relative to said feed conduit, and including means connected with said jet body and positioned at said housing chamber output for rotating said jet body relative to said nozzle feed conduit.

13. The apparatus of claim 11 wherein said jet body is mounted for rotation relative to said feed conduit, wherein said nozzle entrance passage is non-circular and said nozzle feed conduit flow passage is non-circular and adapted to be aligned with the nozzle entrance passage, whereby rotation of said jet body relative to said nozzle feed conduit will effect non-alignment of said passages to change the flow of water over said turbine blade.

14. The apparatus of claim 13 wherein said non-circular passages each comprise a main circular section coaxial with said nozzle and a turbine drive section protruding outwardly from said main section, said rotor blades projecting into the drive section of said nozzle entrance passage but being outside of the main section of said nozzle entrance passage.

15. The apparatus of claim 11 wherein said means for coupling said rotor and flow disturbing member comprises a worm affixed to said rotor, a shaft forming the journal for said flow disturbing member and a gear fixed on said shaft and engaged with said worm.

16. The apparatus of claim 11 wherein said air inlet port is positioned adjacent said nozzle.

17. A method of producing a pulsating discharge of a gas liquid mixture comprising flowing a stream of liquid through an entrance passage into a nozzle to be projected therefrom at increased velocity and reduced pressure into a mixing chamber, flowing air into said chamber, rotating a flow disturbing member downstream of said nozzle in said chamber to intermittently intercept a portion of the projected increased velocity stream of liquid, and adjustably controlling the rotational velocity of said flow disturbing member.

18. The method of claim 17 wherein said step of adjustably controlling comprises positioning a liquid driven rotor to intercept an edge of the liquid stream flowing through said entrance passage, and interconnecting said rotor and flow disturbing member for rotation together with one another.

19. The method of claim 18 including the step of changing the amount of projection of said rotor into the liquid stream flowing in said entrance passage so as to adjust velocity of rotation of said rotor.

20. The method of claim 18, wherein said step of adjustably controlling the rotational velocity of said flow disturbing member further comprises changing the flow of liquid to said rotor thereby changing the rotational speed of said rotor.

* * * * *